United States Patent [19]

Boucher

[11] 4,308,780

[45] Jan. 5, 1982

[54] WARP RESTORING DEVICE FOR THE NECK OF A STRINGED MUSICAL INSTRUMENT

[75] Inventor: Normand Boucher, La Patrie, Canada

[73] Assignee: Les Guitares Norman Inc., La Patrie, Canada

[21] Appl. No.: 140,983

[22] Filed: Apr. 17, 1980

[51] Int. Cl.[3] ..... G10D 3/00
[52] U.S. Cl. ..... 84/293
[58] Field of Search ..... 84/267, 293

[56] References Cited

U.S. PATENT DOCUMENTS

| | | | |
|---|---|---|---|
| 2,460,943 | 2/1949 | Nelson | 84/293 |
| 3,416,399 | 12/1968 | Baldoni | 84/293 |
| 3,443,018 | 5/1969 | Krebs | 84/293 |

FOREIGN PATENT DOCUMENTS

| | | | |
|---|---|---|---|
| 1908603 | 9/1970 | Fed. Rep. of Germany | 84/293 |

*Primary Examiner*—Lawrence R. Franklin
*Attorney, Agent, or Firm*—Alan Swabey; Robert Mitchell; Guy J. Houle

[57] ABSTRACT

A warp restoring device for use in a neck of a stringed musical instrument. The device comprises a pair of rods held in parallel relationship. A connecting block is secured at a common end of the rods. A threaded member cooperates with the connecting block to cause limited axial displacement of one of the rods. A rod connection is spaced from a far end of the rods to immovably interconnect both said rods in a connection zone to control the position of a bending zone for the rods when the threaded member is rotated in a predetermined direction.

10 Claims, 5 Drawing Figures

WARP RESTORING DEVICE FOR THE NECK OF A STRINGED MUSICAL INSTRUMENTcl

BACKGROUND OF INVENTION (a) Field of the Invention

The present invention relates to a warp restoring device for use in the neck of a stringed musical instrument whereby to counteract warping of the neck.

(b) Description of Prior Art

Various types of reinforced necks for stringed musical instruments are known. The most pertinent prior art known to the Applicant is the guitar neck construction as disclosed by U.S. Pat. No. 2,460,943 issued on Feb. 8, 1949. In that patent, there is shown a neck straightening means constituted by two elongated rods which are vertically disposed in a cavity formed in the neck and adjustable to counteract warping of a guitar neck caused by tension of the strings or climatic effects. In this patent, the rods are immovably secured to one another at a far end and by displacing one of the rods axially, the other will bow out to apply a restoring pressure. However, when the rods are in tight fit with the slot in the guitar neck, the restoring pressure, being throughout the length of the rods, is displaced to its weakest resisting area and often the restoring force is of no benefit.

Further, in the prior art, the rods are inserted from the forward end of the neck and an end part thereof is visible. Also, the slot formed in the neck is visible at its end and this is displeasing to the aesthetics of the instrument.

SUMMARY OF INVENTION

The present invention is an improvement over the warp restoring device as described in the above-mentioned prior art and overcomes the above-mentioned disadvantage thereof, by controlling the position of the restoring force in the rods.

A further feature of the present invention is to conceal the restoring device in the neck of a guitar by providing the opening of the slot in the neck in the hollow body of the instrument in proximity to the sound aperture to permit insertion and adjustment of the restoring device.

Another feature of the present invention is to provide a warp restoring device for use in a neck of a stringed musical instrument whereby the device is reversible whereby to counteract warping of the neck in either one of opposed directions.

Another feature of the present invention is to provide a warp restoring device for use in the neck of a stringed musical instrument whereby the bending zone of the rods is controlled by the provision of a rod connection spaced from a far end of the rods and independent of the guitar neck.

Another feature of the present invention is to provide an improved warp restoring device which employs very few parts, is easy to construct, and easy to adjust and wherein the device is concealable within the neck of a stringed musical instrument.

According to the above features, from a broad aspect, the present invention provides a warp restoring device for use in a neck of a stringed musical instrument. The device comprises a pair of rods held in parallel relationship. Connecting means is secured at a common end of the rods. Threaded means cooperate with the connecting means to cause limited axial displacement of one of the rods. A rod connection is spaced from a far end of the rods to immovably interconnect both of the rods in a connection zone to control the position of a bending zone for the rods when the threaded means is rotated in a predetermined direction.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 2:
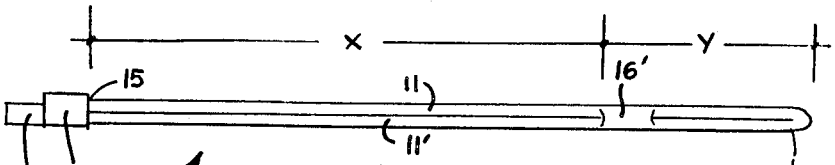
FIG. 2 is a plan view of the warp restoring device of the present invention.
Figure 3:
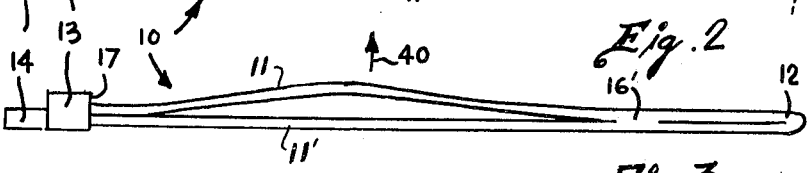
FIG. 3 is a plan view showing the warp restoring device in a condition of use illustrating the bending zone and the connecting zone of the rods.

Referring now to the drawings, and more particularly to FIGS. 2 and 3, there is shown generally at 10, the warp restoring device of the present invention. As shown in FIG. 2, the warp restoring device comprises a pair of rods 11 and 11' held in parallel relationship to one another. Herein, there is a single rod 11 being bent at a far end 12 to constitute the pair of rods 11 and 11'. A connecting means, herein a connecting block 13, is secured at a common end of the rods. A threaded member 14 cooperates with the block 13 and connects to the rod 11', as will be described in detail later, to cause axial displacement of the rod 11' with respect to the rod 11 which is immovably secured at its end 15 within the block 13. A rod connection, herein a weld connection 16', immovably secures the rods 11 and 11' at a position spaced from its far end 12. This position is herein shown as being at approximately four inches from the far end 12 with the length of the rods being approximately fourteen inches.

Figure 5:
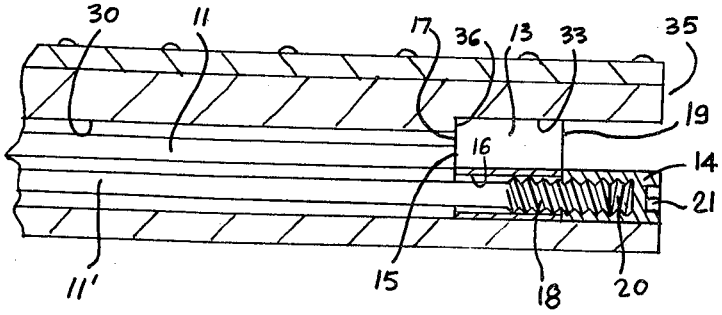
FIG. 5 is an end view showing the position of the warp restoring device.

Referring now to FIG. 5, there is shown the construction of the connecting block 13 and it consists of a brass block having a through bore 16 extending from an end face 17 of the block 13. As previously described, the end 15 of the rod 11 is immovably secured in the end face 17 of the block 13.

The rod 11' has a threaded end portion 18 extending through the bore 16 and out of the front face 19 of the block 13. The threaded member 14 is provided with an elongated threaded bore portion 20 which is in threaded engagement with the threaded end portion 18 of the rod 11'. An engageable means, herein constituted by an Allan keyhole 21, is provided at the opposed end of the threaded member 14 whereby to cause axial rotation of the threaded member 14 to displace the threaded end portion 18 of rod 11' axially within the through bore 16.

Referring to FIG. 3, it can be seen that by rotating the threaded member 14 to axially displace the threaded end portion 18 of the rod 11' into the connecting block 13 inwardly of the end face 17 thereof, that this tension in the rod 11' will cause the rod 11 to arc outwardly away from the rod 11' as the rod 11' is becoming shorter in its bending zone x. This bending zone is defined as the area between the end face 17 of the connecting block 13 and the rod connection 16'. The length of the rods which are immovably retained by the connecting weld 16' forms a connection zone y. This connection zone adds rigidity to the rods 11 and permits to control the precise position of the bending zone x where it is necessary to exert the maximum restoring pressure whilst permitting to conserve a mean pressure in the other areas along the length of the rods.

Figure 1:
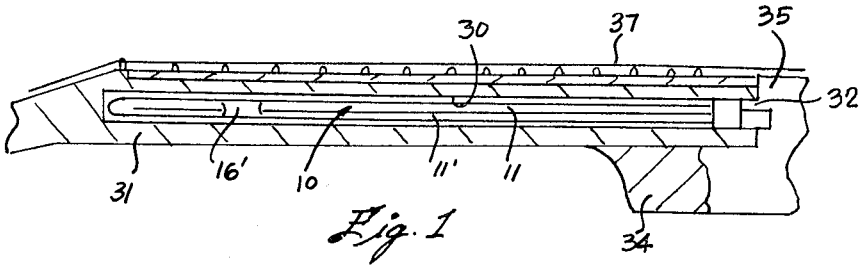
FIG. 1 is a fragmented sectional view of the neck portion of a stringed musical instrument showing the location of the warp restoring device therein.

In use, and as shown in FIG. 1, the warp restoring device 10 is positioned within a longitudinal cavity 30 which is formed in the neck 31 of a musical instrument 32, herein a guitar. This cavity 30 is an elongated narrow vertically extending cavity which is disposed in the neck 31 of the instrument and has an open end 32 located in the body 34 of the guitar under the sound aperture 35 formed in the top face thereof under the strings 37. The opening 32 permits insertion of the device 10 within the neck. By disposing the device 10 through the aperture 35 of the guitar, the end member 14 is concealed, unlike the prior art where the adjustment is from the opposite end of the neck where the device is visible.

As shown more clearly in FIG. 5, the open end portion of the cavity has an enlarged area 33 whereby to locate the connecting block 13 in close fit therein. The end face 17 of the connecting block also serves as an abutment face for the connecting block 13 against ledge 36.

Figure 4:
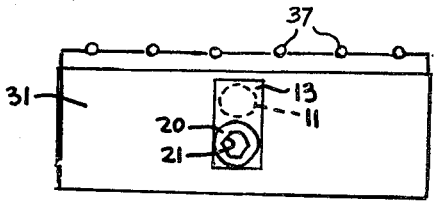
FIG. 4 is a fragmented end section view showing the construction of the connecting block and its location in the open end of the cavity formed in the neck of the musical instrument.

It can be seen that by providing a vertically extending cavity 30 in the neck 31 of the instrument 32 and positioning the rods 11 and 11' aligned vertically with respect to each other, that the restoring force of the rod, in the direction of arrow 40 in FIG. 3, can be applied upwardly or downwardly along the transverse axis of the neck 31 by simply positioning the rod 11' lowermost or uppermost in the cavity 30. As shown in FIG. 4, the connecting block 13 is of a rectangular cross section, and fits into the enlarged portion 33 of the cavity in either opposed vertical positions. Thus, by the provision of a means to select the direction of the restoring force, correction of warping in both directions is possible. Also, the device provides for a decrease in the rejection of warped instrument necks that results during the production of same. Furthermore, the rods 11 and 11' may be constructed of materials having different strengths. For example, it is recommended that for stringed instruments, such as classical guitars, that the rods 11 and 11' be constructed of aluminum. In the case of a western-type guitar, the rods would be constructed of steel. In the event where the neck 31 of the instrument is of a material sensitive to pressure, then the rods may be formed of any desired material that will suit the material from which the neck is constructed.

It is within the ambit of the present invention to cover any obvious modifications of the example of the preferred embodiment described herein, provided such modifications fall within the scope of the broad claims.

I claim:

1. A warp restoring device for use in a neck of a stringed musical instrument, said device comprising a pair of rods held in parallel relationship, connecting means secured at a common end of said rods, threaded means cooperating with said connecting means to cause limited axial displacement of one of said rods, and a rod connection spaced from a far end of said rods to immovably interconnect both said rods in a connection zone to control the position of a bending zone for said rods when said threaded means is rotated in a predetermined direction.

2. A device as claimed in claim 1 wherein said connection means is a support block, said rod connection being a weld connection formed between said pair of rods.

3. A device as claimed in claim 2 wherein said pair of rods are positioned in a longitudinal cavity formed in said neck of a stringed instrument, said cavity being a narrow vertically extending cavity having an open end located in a hollow body of said instrument and accessible through a sound aperture in said body.

4. A device as claimed in claim 3 wherein one of said rods is immovably secured to said connecting block, the other of said rods having a threaded end portion extending in a bore in said block and axially displaceable therein by tightening or untightening said threaded means.

5. A device as claimed in claim 4 wherein said bending zone extends arcuately upward from the normal axis of said axially displaceable rod, said pair of rods being disposed in said cavity of said neck with said axially displaceable rod being lowermost.

6. A device as claimed in claim 5 wherein said rods are reversible in said cavity of said neck with said axially displaceable rod being uppermost.

7. A device as claimed in claim 3 wherein said rods are of circular cross-section, said block being a rectangular block having a rod connecting end face, one of said rods being immovably secured in said connecting end face, the other of said rods having a threaded end portion extending in a through bore in said end face and axially displaceable in said block by tightening or untightening said threaded means.

8. A device as claimed in claim 7 wherein said threaded means is a threaded member having an elongated threaded bore at one end thereof to receive said threaded end portion of said rod in threaded engagement, and engageable means at an opposed end of said threaded member to cause axial rotation thereof whereby said threaded end portion will be displaced axially in said threaded bore.

9. A device as claimed in claim 2 wherein said stringed instrument is a classical guitar, said rods being aluminum rods, said block being constructed of brass material.

10. A device as claimed in claim 2 wherein said stringed instrument is a western-type guitar, said rods being steel rods, said block being constructed of brass material.

* * * * *